US008427343B2

(12) United States Patent
McGuffin et al.

(10) Patent No.: US 8,427,343 B2
(45) Date of Patent: Apr. 23, 2013

(54) METHODS AND SYSTEMS FOR GENERATING DATA LINK AIR TRAFFIC CONTROL CENTER MENUS

(75) Inventors: Thomas F. McGuffin, Bellevue, WA (US); Thomas D. Judd, Woodinville, WA (US); Randy T. Durand, Carnation, WA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 13/463,960

(22) Filed: May 4, 2012

(65) Prior Publication Data

US 2012/0235833 A1 Sep. 20, 2012

Related U.S. Application Data

(62) Division of application No. 12/535,108, filed on Aug. 4, 2009, now Pat. No. 8,193,947.

(51) Int. Cl.
*G08G 5/04* (2006.01)

(52) U.S. Cl.
USPC ..... 340/961; 340/971

(58) Field of Classification Search ..... 340/961, 340/945, 971; 342/36; 701/3, 14
See application file for complete search history.

(56) References Cited

U.S. PATENT DOCUMENTS

| | | | | |
|---|---|---|---|---|
| 5,842,142 | A * | 11/1998 | Murray et al. | 340/951 |
| 6,282,417 | B1 | 8/2001 | Ward | |
| 6,313,759 | B1 | 11/2001 | Musland-Sipper | |
| 6,353,779 | B1 | 3/2002 | Simon | |
| 6,664,945 | B1 | 12/2003 | Gyde et al. | |
| 6,714,783 | B1 | 3/2004 | Simonin et al. | |
| 6,931,248 | B2 | 8/2005 | Borel | |
| 7,495,602 | B2 | 2/2009 | Sandell et al. | |
| 7,979,200 | B2 | 7/2011 | Bay et al. | |
| 2002/0009993 | A1 | 1/2002 | Dastrup et al. | |
| 2008/0163093 | A1 | 7/2008 | Lorido | |
| 2008/0192693 | A1 | 8/2008 | Borel et al. | |
| 2009/0306951 | A1 | 12/2009 | Paletou et al. | |
| 2011/0032123 | A1 | 2/2011 | McGuffin et al. | |

FOREIGN PATENT DOCUMENTS

EP 0743580 11/1996

OTHER PUBLICATIONS

European Patent Office, "Communication under Rule 71(3) EPC", "from Foreign Counterpart of U.S. Appl. No. 12/535,108", filed Feb. 24, 2012, pp. 1-6.
European Patent Office, "European Search Report", "from Foreign Counterpart of U.S. Appl. No. 12/535,108", filed Aug. 24, 2012, pp. 1-3, Published in: EP.
European Patent Office, "European Search Report", "from Foreign Counterpart of U.S. Appl. No. 12/535,108", filed Aug. 24, 2012, pp. 13, Published in: EP.

(Continued)

*Primary Examiner* — John A Tweel, Jr.
(74) *Attorney, Agent, or Firm* — Fogg & Powers LLC

(57) ABSTRACT

Methods and systems for generating a data link air traffic control center menu are provided. In one implementation, a method includes calculating a distance between each of a plurality of air traffic control centers and an aircraft during flight. The method further includes displaying a sorted list of the plurality of air traffic control centers, wherein the list is sorted by the calculated distance, from closest to the aircraft to farthest from the aircraft. The method further includes receiving an input, the input selecting one of the air traffic control centers.

20 Claims, 14 Drawing Sheets

OTHER PUBLICATIONS

U.S. Patent and Trademark Office, "Notice of Allowance", "U.S. Appl. No. 12/535,108", Mar. 16, 2012, pp. 1-20.
European Patent Office, "Office Action", Feb. 7, 2011, Published in: EP.
European Patent Office, "European Search Report", mailed Jan. 31, 2011, Published in: EP.
European Patent Office, "Partial Eurpean Search Report", mailed Oct. 15, 2010, Published in: EP.
European Patent Office, "Office Action", "from Foreign Counterpart of U.S. Application", Sep. 7, 2012, pp. 1-5, Published in: EP.
European Patent Office, "Office Action", "from Foreign Counterpart of U.S. Application", Sep. 5, 2012, pp. 1-6, Published in: EP.

* cited by examiner

METHODS AND SYSTEMS FOR GENERATING DATA LINK AIR TRAFFIC CONTROL CENTER MENUS

This application is a divisional of U.S. application Ser. No. 12/535,108, filed on Aug. 4, 2009, the disclosure of which is incorporated herein by reference.

BACKGROUND

Air traffic control (ATC) centers are used at most airports to coordinate take-offs, landings, and general aircraft traffic around the airport. Traditionally, a pilot uses a radio to speak to an ATC center to request permission or to receive instructions from the ATC center. With increasing air traffic, it has become difficult for ATC centers and pilots to process all of the oral communications with aircraft without error. Consequently, data link applications have been developed to provide textual communications between pilots and air traffic controllers.

One of these data link applications, called Controller Pilot Data Link Communication (CPDLC), provides for the direct exchange of text-based messages between a controller and a pilot. The CPDLC application enables the pilot to communicate electronically with an ATC center by guiding the pilot through a series of screen configurations or displays that either elicit flight information from the pilot or notify the pilot regarding flight information. The CPDLC application may be part of a larger flight information/control program or may serve as a stand-alone program.

ATC centers deploy data link applications, such as CPDLC and Context Management (CM), which allow the ATC controller and a pilot to communicate via electronic messages delivered through the Aeronautical Telecommunication Network (ATN). To have electronic message communication through CPDLC and CM, the pilot must first select an ATC center from a list of available ATC centers using a flight computer. In current CPDLC systems, avionics systems such as a Communication Management Unit (CMU) or a Flight Management Computer (FMC) include interfaces configured to allow pilots and/or flight crews to select the desired ATC center from the list of available ATC centers. There are over 100 ATC centers in the world from which the pilot must select one. Typically, aircraft flight computers have limited resolution displays, complicating the efficient presentation of available ATC centers.

A Human-Machine Interface (HMI) common to many aircraft avionics is the Multifunction Control Display Unit (MCDU). The MCDU has a display area of only 14 lines in height by 24 characters in width. In current applications, the pilot and/or flight crew is required to scroll through the list of available ATC centers to find and select the desired ATC center. In current applications, the ATC centers are listed in the order they are stored in a database. The database is typically static with no hierarchal order or logic to facilitate quick selection. Thus, pilots and/or flight crew are often required to scroll through multiple screens of ATC center lists to find the appropriate ATC center.

SUMMARY

Methods and systems for generating a data link air traffic control center menu are provided. In one implementation, a method includes calculating a distance between each of a plurality of air traffic control centers and an aircraft during flight. The method further includes displaying a sorted list of the plurality of air traffic control centers, wherein the list is sorted by the calculated distance, from closest to the aircraft to farthest from the aircraft. The method further includes receiving an input, the input selecting one of the air traffic control centers.

BRIEF DESCRIPTION OF THE DRAWINGS

Features of the present invention will become apparent to those skilled in the art from the following description with reference to the drawings. Understanding that the drawings depict only typical embodiments of the invention and are not therefore to be considered limiting in scope, the invention will be described with additional specificity and detail through the use of the accompanying drawings, in which.

DETAILED DESCRIPTION

In the following detailed description, embodiments are described in sufficient detail to enable those skilled in the art to practice the invention. It is to be understood that other embodiments may be utilized without departing from the scope of the present invention. The following detailed description is, therefore, not to be taken in a limiting sense.

The present invention is directed to methods and systems for generating a data link air traffic control center menu. In general, the methods and systems provide for hierarchically organizing, displaying, and selecting Air Traffic Control (ATC) center objects in a database. The present methods provide for efficiently selecting a desired ATC center from a long list of possibilities, thereby reducing aircraft crew workload and minimizing pilot head down time.

In one approach, a plurality of ATC center objects are organized and presented to pilots and/or flight crew onboard an aircraft. Each ATC center object represents an air traffic control center and includes a name and geographic location data. The geographic location data of the plurality of ATC center objects is organized by a processor into a geographic hierarchy based on geographic location data for the plurality of ATC center objects. Thereafter, the names of the plurality of ATC center objects is presented to the pilots and/or flight crew in a manner consistent with the geographic hierarchy. Typically, input is received from the pilots and/or flight crew, the input selecting a particular ATC center object from the plurality of ATC center objects. Thereafter, a data communication link is established with the air traffic control center represented by the particular ATC center object.

The present methods can be implemented in a communication management function (CMF) of a communication management unit (CMU); in a flight management computer (FMC) such as an FMC hosting Controller Pilot Data Link Communication (CPDLC) applications; or in any other avionics computer in an aircraft. The present methods can also be a part of the communication protocols for aeronautical telecommunication network (ATN) CPDLC systems.

The present methods can be implemented for an aircraft by modifying conventional avionics software to add appropriate logic steps to perform the methods. The geographic hierarchy used in a particular approach can be implemented according to any of the specific implementations described below.

The methods and systems of the present invention are described in further detail as follows with reference to the drawings.

Figure 1:
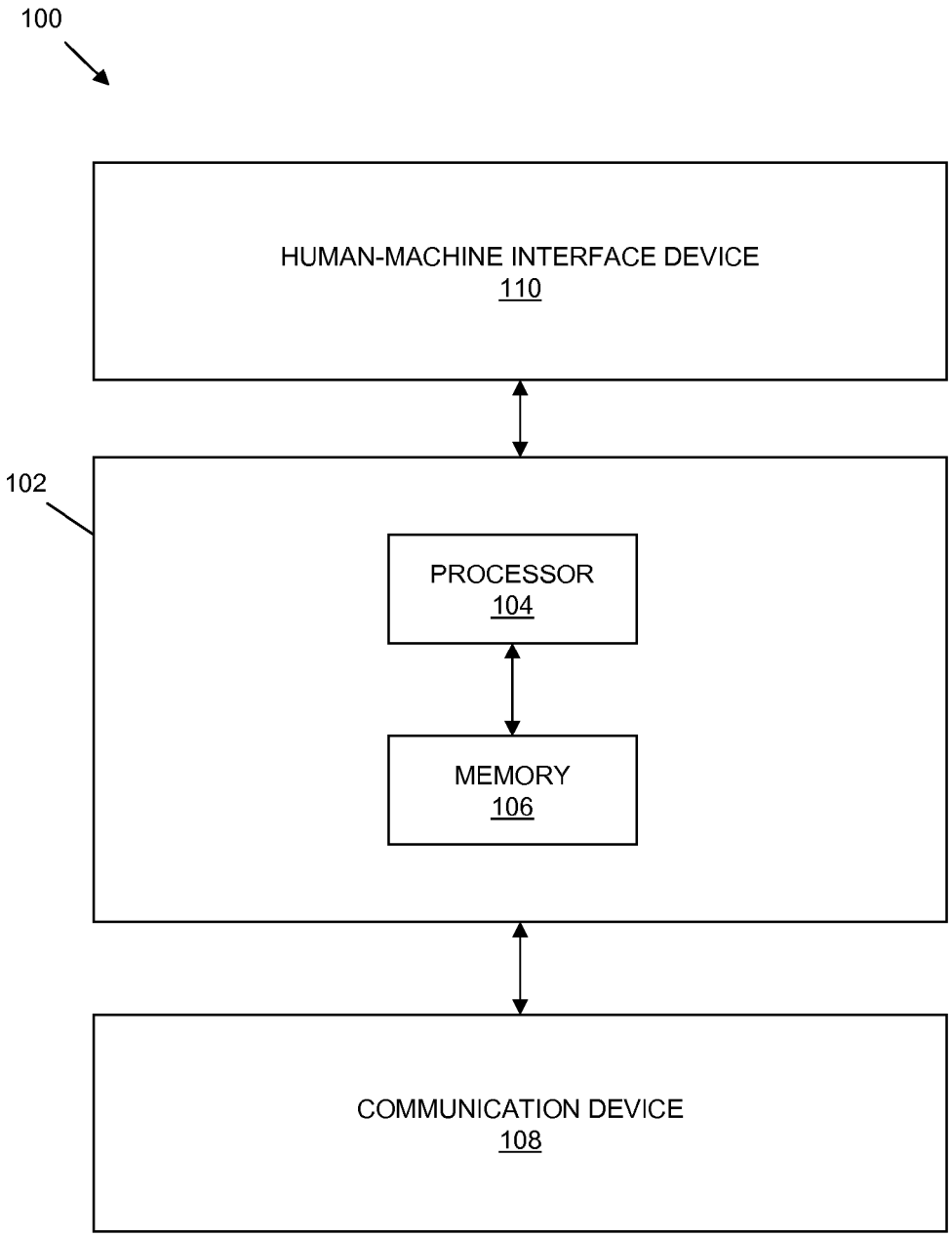
FIG. 1 is a block diagram of a computer system that can implement the methods of the invention.

FIG. 1 is a block diagram of a data communication computer system 100 that can implement the present method. The computer system 100 can be implemented as a communications management unit, a flight management computer, a communications management function, a flight management function, or any other avionics computer. The computer system 100 comprises a processing and storage platform 102, which includes at least one processor 104 and at least one memory 106 in operative communication with processor 104. The computer system 100 can also incorporate a data communication device 108, to enable transmission and reception of various communications and data link messages such as CPDLC application messages. The data communication device 108 is in operative communication with processor 104 and memory 106. The computer system 100 also includes a Human-Machine Interface (HMI) device 110, such as those currently used by pilots in the cock-pits of various aircraft. Examples of HMI device 110 include a Multi-Control Display Unit (MCDU) and a Multi Function Display (MFD) system.

The processor 104 can be implemented using software, firmware, hardware, or any appropriate combination thereof, as known to one of skill in the art. By way of example and not limitation, hardware components for processor 104 can include one or more microprocessors, memory elements, digital signal processing (DSP) elements, interface cards, and other standard components known in the art. Any of the foregoing may be supplemented by, or incorporated in, specially-designed application-specific integrated circuits (ASICs) or field programmable gate arrays (FPGAs). In this exemplary embodiment, processor 104 includes or functions with software programs, firmware, or other computer readable instructions for carrying out various process tasks, calculations, and control functions, used in the present method. These instructions are typically tangibly embodied on any appropriate medium used for storage of computer readable instructions or data structures.

The memory 106 can be implemented with any available computer readable storage media that can be accessed by a general purpose or special purpose computer or processor, or any programmable logic device. Suitable computer readable media may include storage or memory media such as magnetic or optical media. For example, storage or memory media may include conventional hard disks, Compact Disk-Read Only Memory (CD-ROM), DVDs, volatile or non-volatile media such as Random Access Memory (RAM) (including, but not limited to, Synchronous Dynamic Random Access Memory (SDRAM), Double Data Rate (DDR) RAM, RAMBUS Dynamic RAM (RDRAM), Static RAM (SRAM), and the like), Read Only Memory (ROM), Electrically Erasable Programmable ROM (EEPROM), flash memory, and the like. Suitable processor-readable media may also include transmission media such as electrical, electromagnetic, or digital signals, conveyed via a communication medium such as a network and/or a wireless link. Combinations of the above are also included within the scope of computer readable media.

The method of the invention can be implemented in computer readable instructions, such as program modules or applications, which are executed by a data processor. Generally, program modules or applications include routines, programs, objects, data components, data structures, algorithms, and the like, which perform particular tasks or implement particular abstract data types. These represent examples of program code means for executing steps of the methods disclosed herein. The particular sequence of such executable instructions or associated data structures represent examples of corresponding acts for implementing the functions described in such steps.

Figure 2:
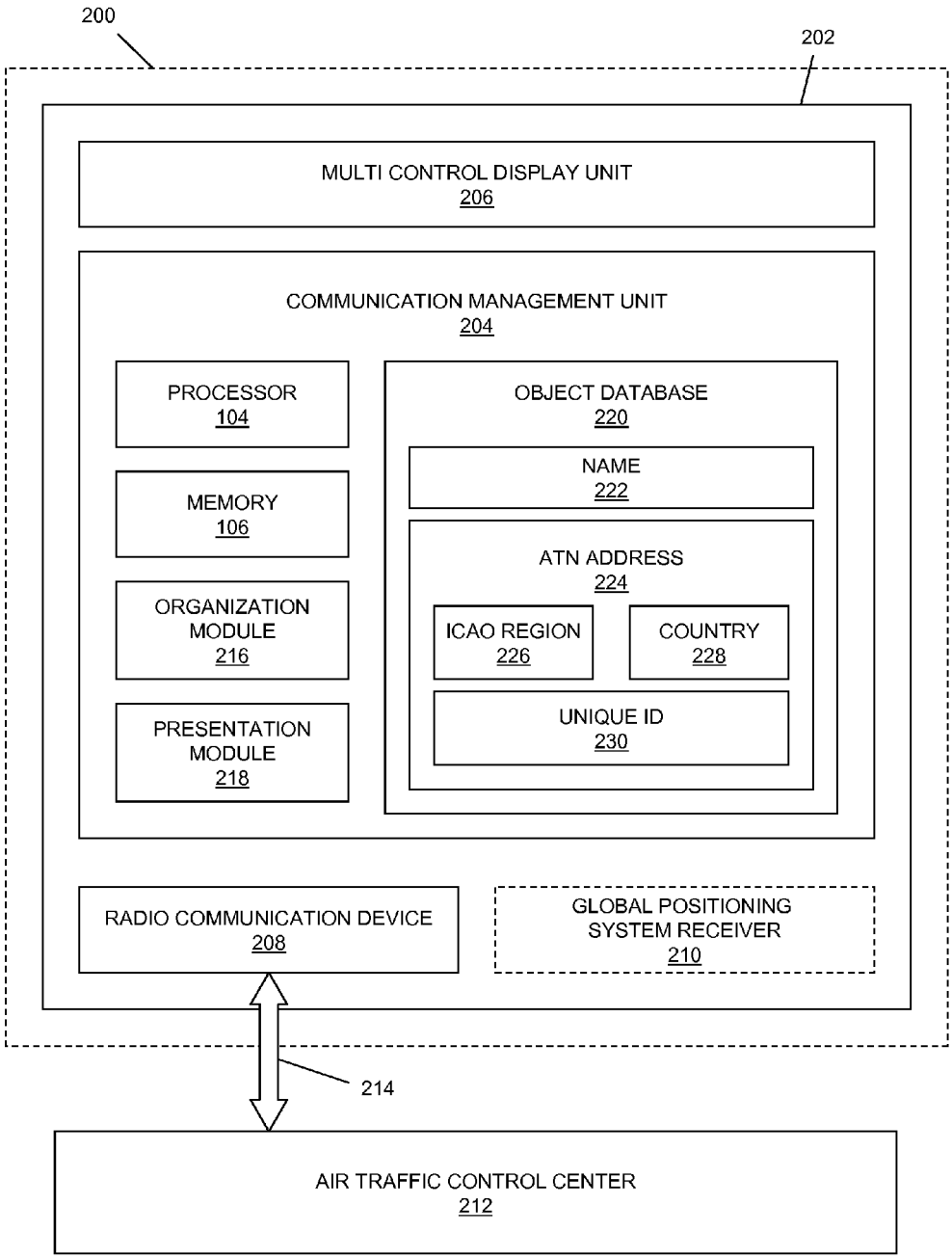
FIG. 2 is a block diagram of a specific embodiment of a computer system that can implement methods of the invention.

FIG. 2 is a block diagram of an aircraft 200 having a computer system 202 that can implement a method of the invention. The computer system 202 is typically onboard aircraft 200. The computer system 202 is implemented using a communication management unit 204, though it can also be implemented as a flight management computer, a communications management function, a flight management function, or any other avionics computer according to computer system 100 of FIG. 1. The communication management unit 204 performs functions similar to processing and storage platform 102 and includes processor 104 and memory 106 as described with reference to computer system 100 of FIG. 1.

The computer system 202 also includes a Multi-Control Display Unit (MCDU) 206, a specific type of user interface device similar to HMI device 110 of FIG. 1. In other embodiments, a MFD or other display system can be used instead of MCDU 206. The MCDU 206 is used to display information to, and receive input from, pilot and/or flight crew onboard aircraft 200. The computer system 202 also includes a radio communication device 208. The radio communication device 208 is configured to communicatively connect with an air traffic control center 212 via a data link 214. The method discussed below aids the pilots and/or flight crew in the selection of air traffic control center 212 from a plurality of air traffic control centers. In some embodiments, a global positioning system receiver 210 is included and configured to aid the pilot and/or flight crew in the selection of air traffic control center 212 according to the methods below.

The communication management unit 204 of computer system 202 includes an organization module 216, a presentation module 218, and an object database 220. In some embodiments, organization module 216 and presentation module 218 are implemented using processor 104 and memory 106. The organization module 216 is configured to organize a plurality of ATC center objects stored in object database 220 in a heirarchal manner. The operation of organization module 216 is detailed in a method described below. The presentation module 218 is configured to present the plurality of ATC center objects from object database 220 to the pilots and/or flight crew according to the hierchal organization performed by organization module 216. The operation of presentation module 218 is detailed in a method described below. The object database 220 typically includes a plurality of ATC center objects. Each individual ATC center object in object database 220 includes a name 222 and an ATN address 224. Each name 222 is typically a descriptive name of a specific ATC center represented by the particular ATC center object in object database 220. Each name 222 is typically recognizable by the pilots and/or flight crew interacting with MCDU 206. The ATN address 224 is associated with each name 222 and represents the actual ATN address of the air traffic control center represented by the particular ATC center object in object database 220.

Figure 3:
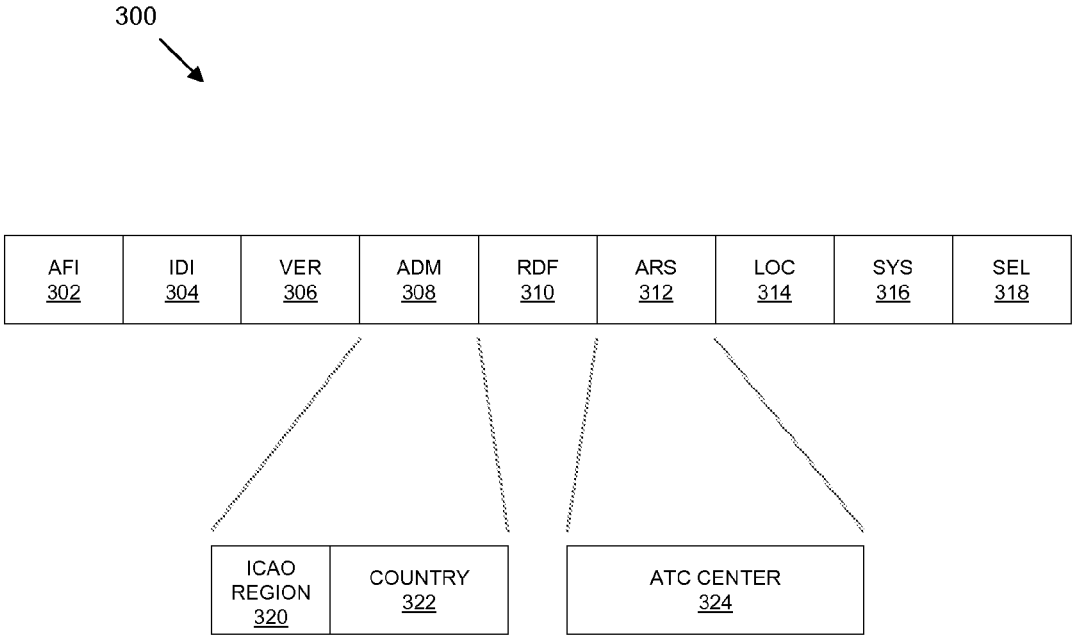
FIG. 3 is a block diagram of an example Aeronautical Telecommunication Network (ATN) Network Service Access Point address format for an Air Traffic Control (ATC) center.

FIG. 3 is a block diagram of an example ATN address format 300. Though the ATN address format 300 has been previously set, it will be described here because parts of it are used in the methods of the invention. The ATN address format 300 typically includes a plurality of different fields containing information about a particular ATC center associated with a particular ATN address. Specifically, the ATN address format 300 includes an Authority and Format Identifier (AFI) field 302, an Initial Domain Identifier (IDI) field 304, a Version Identifier (VER) field 306, an Administration Identifier (ADM) field 308, a Routing Domain Format (RDF) field 310, an Administrative Region Selector (ARS) field 312, a Location Identifier (LOC) field 314, a System Identifier (SYS) field 316, and a Network Service Access Point (NSAP) Selector (SEL) field 318. The ADM field 308 and the ARS field 312 are used in implementation of specific embodiments of the invention.

The International Civil Aviation Organization (ICAO) is part of the United Nations that codifies principles and techniques of international aeronautical navigation. The ICAO has divided the earth into nine geographic ICAO regions 320: Africa, Asia, Caribbean, Europe, Middle East, North America, North Atlantic, Pacific, and South America. The ATN address representing a particular ATC center typically includes ADM field 308, which is divided into a first portion identifying an ICAO region 320 and a second portion identifying a country 322 where the ATC center represented by the particular ATN address is located. Each of the ICAO regions 320 is typically represented in the first portion of ADM field 308 of an ATN address using a predetermined hexadecimal value. Typically, each ICAO region 320 is assigned the following hexadecimal values: Africa is 0x80, Asia is 0x81, Caribbean is 0x82, Europe is 0x83, Middle East is 0x84, North America is 0x85, North Atlantic is 0x86, Pacific is 0x87, and South America is 0x88. The ICAO region 320 from the first portion of ADM field 308 is typically stored in object database 220 as an ICAO region 226 in ATN address 224 as shown in FIG. 2.

A second portion of ADM field 308 indicates country 322 where the ATC center represented by a particular ATN address is located. Each country 322 within a particular ICAO region 226 is typically represented in the second portion of ADM field 308 of an ATN address using the ASCII hexadecimal equivalents of the country's two letter country code. For example, Germany has a two letter country code "DE". Thus, its ADM field would include the hexadecimal code for Europe's ICAO region 320 followed by the hexadecimal representation of "DE", or 0x834445. Similarly, these other example European countries have the following ADM codes: Ireland is 0x834945 ("IE"), Italy is 0x834954 ("IT"), Luxemburg is 0x834C55 ("LU"), the Netherlands is 0x834E4C ("LU"), Portugal is 0x835054 ("PT"), Spain is 0x834583 ("ES"), and the UK is 0x834742 ("GB"). This pattern of ICAO region code+two letter country code is followed for countries in all of the ICAO regions. In some embodiments, other sub-categories, other than countries, are also accessible under a particular ICAO region 320. For example, in some embodiments, Eurocontrol has an ADM code of 0x836575 ("eu"), NATO in Europe has an ADM code of 0x836E61 ("na"), and the European Top Level Backbone has a ADM code of 0x8380BB. The country 322 from the second portion of ADM field 308 is typically stored in object database 220 as a country 228 in ATN address 224 as shown in FIG. 2.

The ATN address representing a particular ATC center typically includes ARS field 312, which uniquely identifies a specific ATC center 324 represented by the particular ATN address. The unique identification for ATC center 324 is typically stored in object database 220 as a unique ID 230 in ATN address 224. Thus, ATN address 224 uniquely identifies each individual ATC center represented by a particular ATC center object by unique ID 230, and also identifies both ICAO region 226 and country 228 in which each individual ATC center represented by a particular ATC center object is located.

Figure 4:
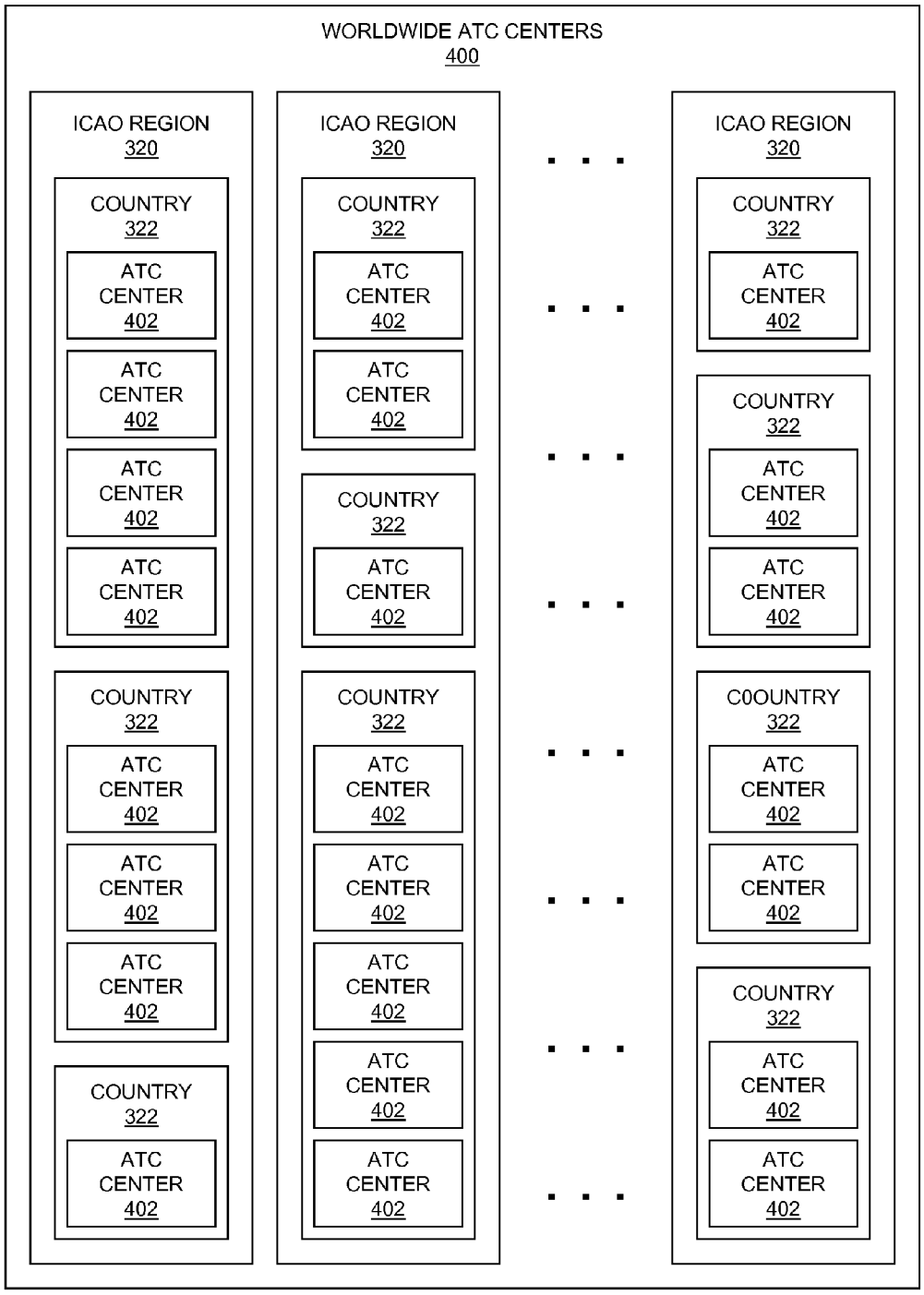
FIG. 4 is a hierarchal representation of worldwide ATC centers used in the implementation of methods of the invention.

FIG. 4 is a hierarchal representation of worldwide ATC centers 400 used in the implementation of methods of the invention. The worldwide ATC centers 400 are hierarchically organized based on ICAO region 320 and country 322. The worldwide ATC centers 400 are typically organized into a plurality of ICAO regions 320 based on geographic boundaries defined by the ICAO. In an example embodiment, worldwide ATC centers 400 are divided into the nine ICAO regions 320 discussed above: Africa, Asia, Caribbean, Europe, Middle East, North America, North Atlantic, Pacific, and South America. The worldwide ATC centers 400 found in each ICAO region 320 are further organized into a plurality of countries 322 found within each ICAO region 320. For example, North America's ICAO region 320 may include the following countries 322: the United States of America, Canada, Mexico, Costa Rica, Honduras, and Panama. The individual ATC centers 402 are then appropriately hierarchically placed within each country 322 of each ICAO region 320. For example, a number of individual ATC centers 402 found within Canada are hierarchically placed within Canada's country 322 of North America's ICAO region 320. The ICAO regions 320, countries 322, and ATC centers 402 shown in FIG. 4 are merely representative of an example hierarchal structure. The actual hierarchal structure used depends on the current definition of ICAO regions 320, countries 322, and ATC centers 402.

While ATC centers 402 shown in FIG. 4 are included in only one ICAO region 320 and one country 322, in other embodiments and implementations, ATC centers 402 are included in multiple ICAO regions 320 and/or multiple countries 322 simultaneously. In some of these embodiments and implementations, ATC centers 402 positioned at the border of an ICAO region 320 or a country 322 and are included in both ICAO regions 320 or countries 322. In other embodiments and implementations, there may be other compelling reasons to include some ATC centers 402 in multiple ICAO regions 320 or countries 322.

Figure 5:
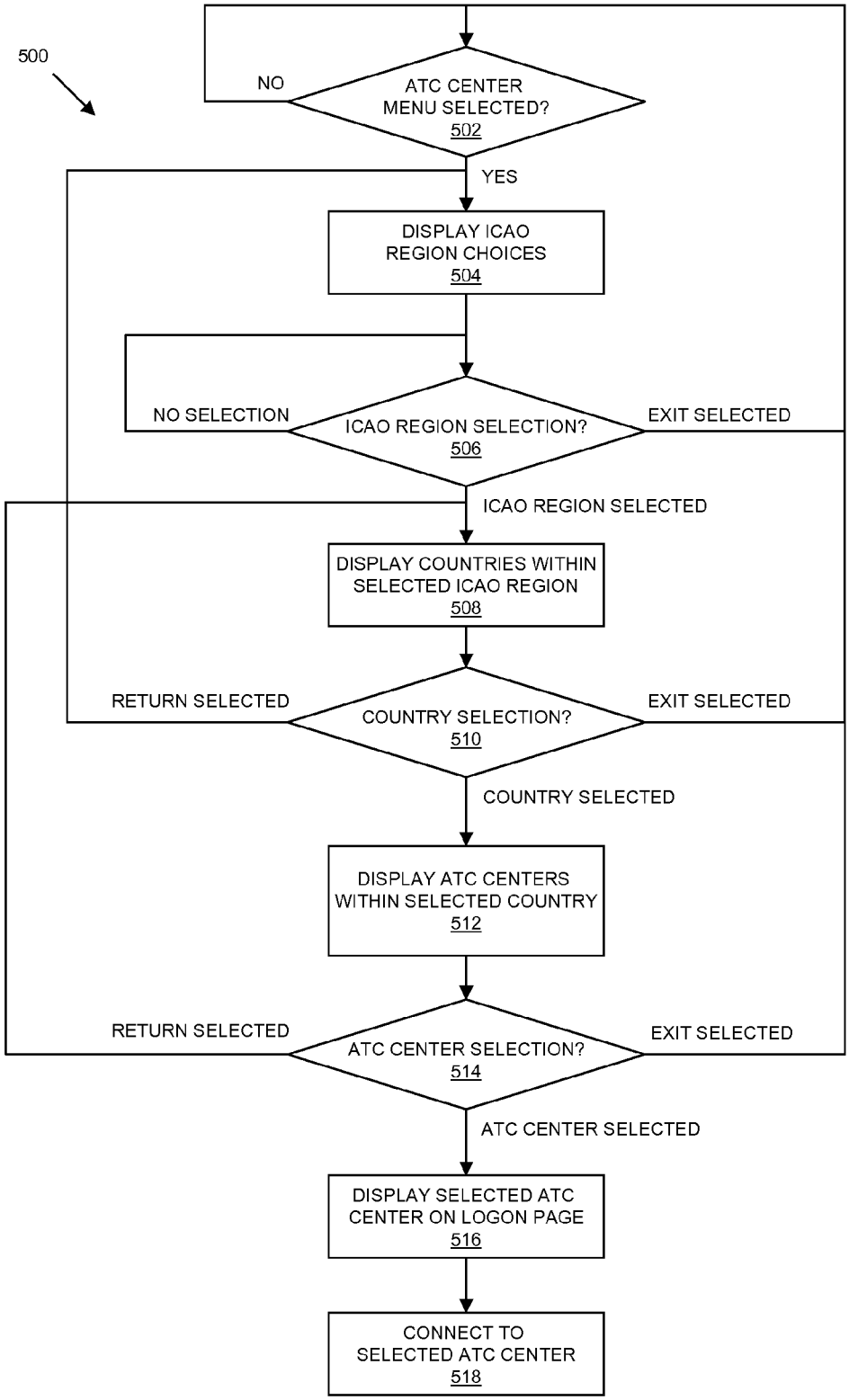
FIG. 5 is a flow diagram representing a method of organizing and presenting a plurality of ATC center objects in a hierarchal manner using the computer system of FIG. 2.

FIG. 5 is a flow diagram representing a method 500 of organizing and presenting a plurality of ATC center objects in a hierarchal manner using computer system 202. The method 500 is typically implemented using organization module 216 and presentation module 218 of communication management unit 204. The method 500 starts when a determination is made whether an ATC center menu is selected (block 502). The ATC center menu is typically selected by a pilot and/or flight crew. The pilot and/or flight crew is typically required to select an ATC center with which to establish an initial data link. The selection is typically made using an input device, such as a button on the MCDU 206. The method 500 waits until the ATC center menu is selected (block 502). If the ATC center menu is selected, then the ICAO region choices are displayed for selection by the pilot and/or flight crew on MCDU 206 (block 504). Typically, a screen listing the nine ICAO regions is displayed with each of the nine ICAO regions listed above available for selection.

A determination is then made as to whether an ICAO region selection has been made (block 506). If an ICAO region is selected from the displayed ICAO regions, then the countries within the selected ICAO region are displayed for selection by the pilot and/or flight crew on MCDU 206 (block 508). If the exit button is selected, then it is again determined whether the ATC center menu is selected (block 502). The method 500 then proceeds as described above until an ICAO region is selected (block 506). If no selection is made, then a determination is again made as to whether an ICAO region selection has been made (block 506). The method 500 then proceeds as described above until an ICAO region is selected (block 506).

After the countries within the selected ICAO region are displayed for selection by the pilot and/or flight crew on MCDU 206 (block 508), a determination is made as to whether a country selection has been made (block 510). If a country is selected from the displayed countries within the selected ICAO region, then the individual ATC centers within the selected country are displayed for selection by the pilot and/or flight crew on MCDU 206 (block 512). If the exit button is selected, then it is again determined whether the ATC center menu is selected (502). If the return button is selected, then the ICAO region choices are again displayed for selection by the pilot and/or flight crew on MCDU 206 (block 504) and a determination is then made as to whether an ICAO region selection has been made (block 506).

If the individual ATC centers within the selected country are displayed for selection by the pilot and/or flight crew on MCDU 206 (block 512), a determination is made as to whether an ATC center selection has been made (block 514). If an ATC center is selected from the ATC centers within the selected country, then the air traffic control center 212 is displayed on the logon page (block 516) from which the flight crew can send a logon message via radio communication device 208 to establish data link 214 between radio communication device 208 and air traffic control center 212. If the exit button is selected, then it is again determined whether the ATC center menu is selected (block 502). If the return button is selected, then the countries within the selected ICAO region are again displayed for selection by the pilot and/or flight crew on MCDU 206 (block 508) and a determination is made as to whether a country selection has been made (block 510). The method 500 then proceeds as described above.

In some implementations of method 500, the current location of the aircraft 200 is retrieved from the global positioning system receiver 210 and used to automatically select the ICAO region in which the aircraft 200 is currently located. In these implementations of method 500, blocks 504 and 506 are skipped, such that when the ATC center menu is selected (block 502), the ICAO region in which the aircraft 200 is currently located is automatically selected and the countries within the selected ICAO region are displayed (block 508). The method 500 then proceeds as described above. In other implementations of method 500, the current location of the aircraft 200 is retrieved from the global positioning system receiver 210 and used to automatically select the country in which the aircraft 200 is currently located. In these implementations of method 500, blocks 504, 506, 508, and 510 are skipped, such that when the ATC center menu is selected (block 502), the country in which the aircraft 200 is currently located is automatically selected and the ATC centers within the selected country are displayed (block 512). The method 500 then proceeds as described above. In other example embodiments, the current location of the aircraft 200 is retrieved from a navigation system, such as a FMC, or another device.

Figure 6:
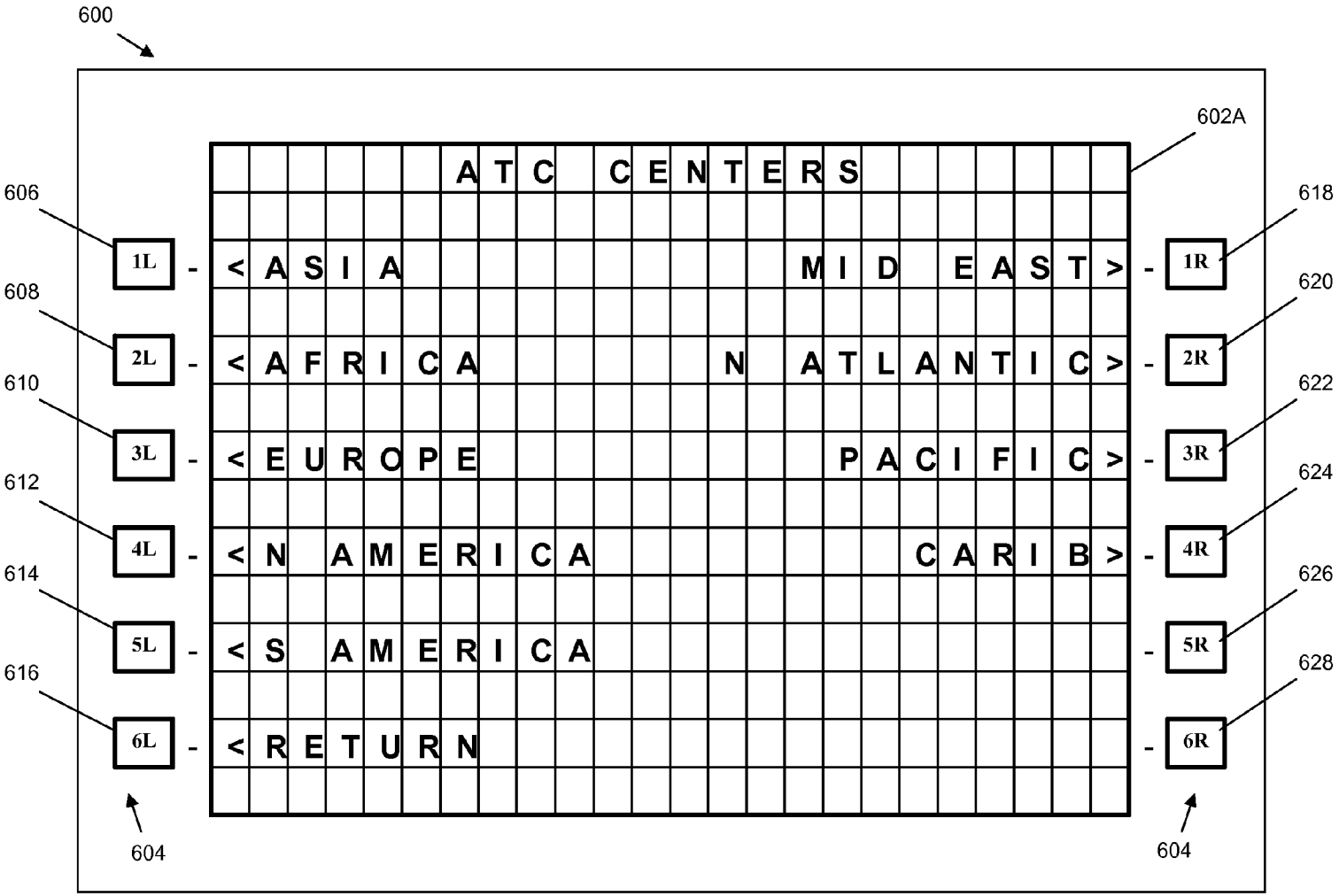
FIG. 6 depicts a multi control display unit showing an exemplary Region Select page displaying the names of a plurality of regions containing a plurality of countries.

FIG. 6 depicts a multi control display unit 600 showing an exemplary ICAO region select page 602A displaying the names of a plurality of ICAO regions containing a plurality of countries according to method 500 (block 504). The multi control display unit 600 includes a plurality of buttons 604 or other appropriate input devices, such as a keyboard or keypad. Each button of the multi control display unit 600 can be associated with a particular onscreen selection. As shown on the multi control display unit 600 showing exemplary ICAO region select page 602A, a button 606 is associated with a selection "ASIA", a button 608 is associated with a selection "AFRICA", a button 610 is associated with a selection "EUROPE", a button 612 is associated with a selection "N AMERICA", a button 614 is associated with a selection "S AMERICA", a button 616 is associated with a selection "RETURN", a button 618 is associated with a selection "MID EAST", a button 620 is associated with a selection "N ATLANTIC", a button 622 is associated with a selection "PACIFIC", and a button 624 is associated with a selection "CARIB". In exemplary ICAO region select page 602A shown in FIG. 6, a button 626 and a button 628 are not associated with any selections. An ICAO region selection can be made by the pilot and/or flight crew by pushing the appropriate button.

Figure 7:
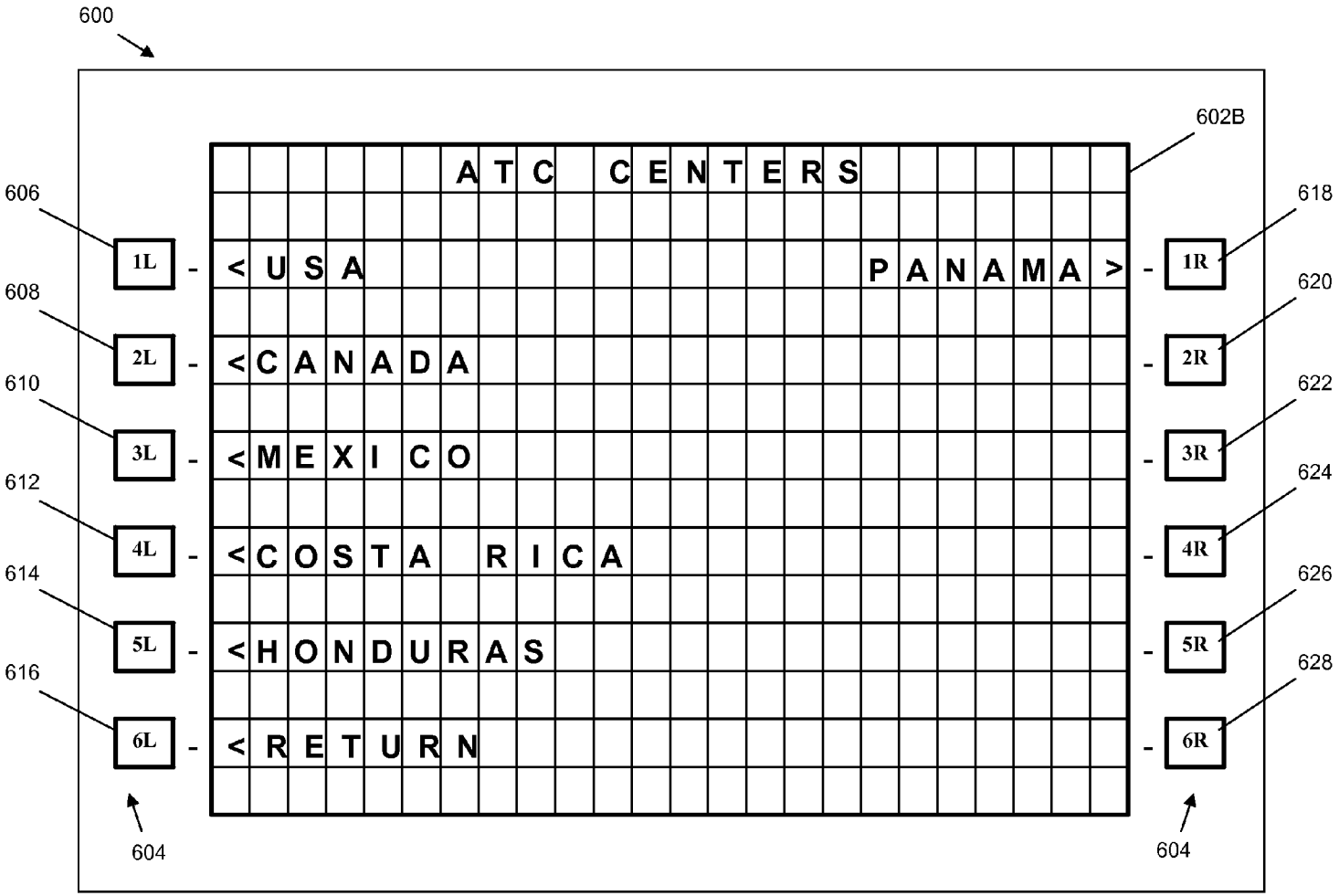
FIG. 7 depicts the multi control display unit of FIG. 6, showing an exemplary Country Select page displaying the names of a plurality of countries found within one of the regions from FIG. 6, each country containing at least one ATC center.

FIG. 7 depicts the multi control display unit 600 showing an exemplary country select page 602B displaying the names of a plurality of countries found within one of the regions according to method 500 (block 508), each country containing at least one ATC center. As shown on the multi control display unit 600 showing exemplary Country Select page 602B, button 606 is associated with a selection "USA", button 608 is associated with a selection "CANADA", button 610 is associated with a selection "MEXICO", button 612 is associated with a selection "COSTA RICA", button 614 is associated with a selection "HONDURAS", button 616 is associated with a selection "RETURN", and button 618 is associated with a selection "PANAMA". In exemplary country select page 602B shown in FIG. 7, button 620, button 622, button 624, button 626, and button 628 are not associated with any selections. A country selection can be made by the pilot and/or flight crew by pushing the appropriate button.

Figure 8:
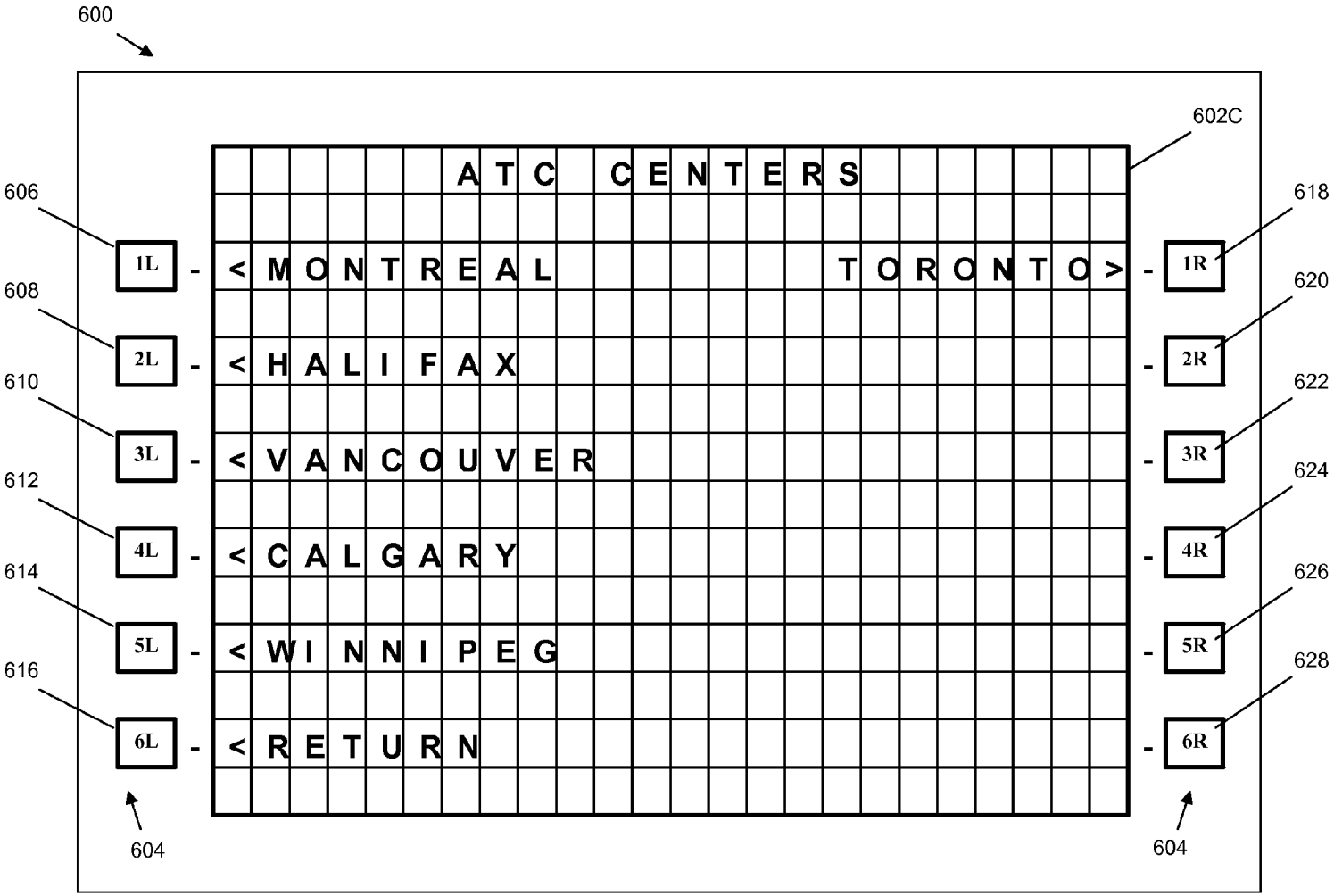
FIG. 8 depicts the multi control display unit of FIG. 6, showing an exemplary ATC Center Select page displaying the names of at least one ATC center found within one of the countries from FIG. 7, each country containing at least one ATC center.

FIG. 8 depicts the multi control display unit 600, showing an exemplary ATC center select page 602C displaying the names of at least one ATC center found within one of the countries according to method 500 (block 512). As shown on the multi control display unit 600 showing the exemplary ATC Center Select page 602C, button 606 is associated with a selection "MONTREAL", button 608 is associated with a selection "HALIFAX", button 610 is associated with a selection "VANCOUVER", button 612 is associated with a selection "CALGARY", button 614 is associated with a selection "WINNIPEG", button 616 is associated with a selection "RETURN", and button 618 is associated with a selection "TORONTO". In exemplary ATC center select page 602C shown in FIG. 8, button 620, button 622, button 624, button 626, and button 628 are not associated with any selections. An ATC center selection can be made by the pilot and/or flight crew by pushing the appropriate button.

Figure 9:
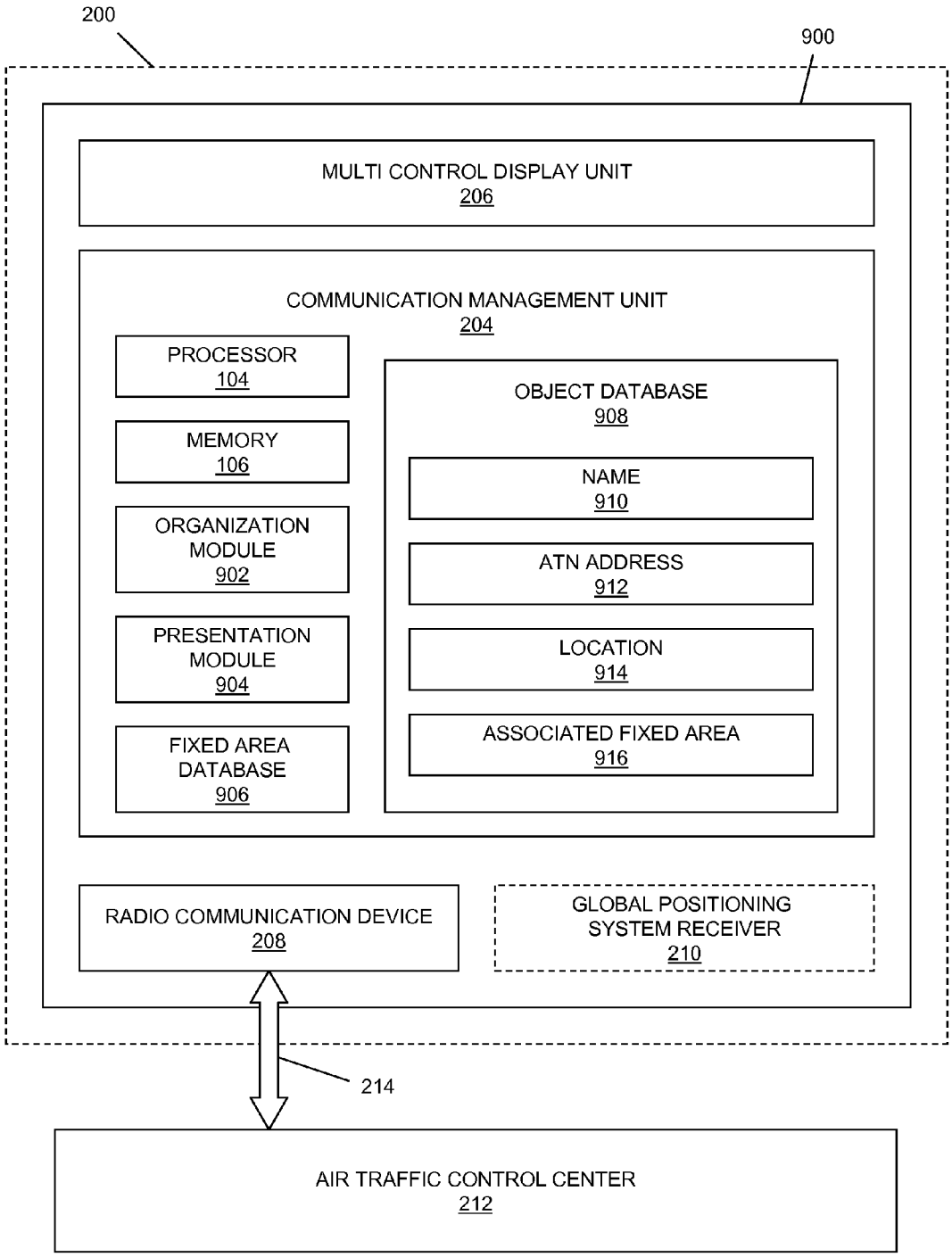
FIG. 9 is a block diagram of another specific embodiment of a computer system that can implement another method of the invention.

FIG. 9 is a block diagram of aircraft 200 having a computer system 900 that can implement another method of the invention. The computer system 900 is typically onboard aircraft 200. The computer system 900 is implemented using communication management unit 204, though it can also be implemented as a flight management computer, a communications management function, a flight management function, or any other avionics computer according to computer system 100 of FIG. 1. The communication management unit 204 performs functions similar to processing and storage platform 102 and includes processor 104 and memory 106 as described with reference to computer system 100 of FIG. 1.

As with computer system 202 above, computer system 900 also includes MCDU 206, though in other embodiments a MFD or other display system can be used instead of MCDU 206. The computer system 900 also includes radio communication device 208 configured to communicatively connect with air traffic control center 212 via data link 214. The methods discussed below aid the pilots and/or flight crew in the selection of air traffic control center 212 from a plurality of air traffic control centers. The computer system 900 shown typically includes global positioning system receiver 210, which is configured to aid the pilot and/or flight crew in the selection of air traffic control center 212 according to the methods detailed below.

The communication management unit 204 of computer system 900 includes an organization module 902, a presentation module 904, a fixed area database 906, and an object database 908. The organization module 902 is configured to organize a plurality of ATC center objects stored in object database 908 in a heirarchal manner detailed below. The presentation module 904 is configured to present the plurality of ATC center objects from object database 908 to the pilots and/or flight crew according to the hierchal organization performed by organization module 902 detailed below. The fixed area database 906 includes a number of geographic areas in which ATC centers are located.

The object database 908 typically includes a plurality of ATC center objects. Each individual ATC center object in object database 908 includes name 910, ATN address 912, a location 914, and an associated fixed area 916. Each name 910 is typically a descriptive name of a specific ATC center represented by the particular ATC center object in object database 908. Each name 910 is typically recognizable by the pilots and/or flight crew interacting with MCDU 206. The ATN address 912 associated with each ATC control center object represents the actual unique ATN address of the ATC center represented by the particular ATC center object in object database 908. The location 914 associated with each ATC center object represents the physical location, in latitude and longitude, of the ATC center represented by the particular ATC center object in object database 908. The associated fixed area 916 associated with each ATC center object represents the particular fixed area, from fixed area database 906, in which the ATC center represented by the particular ATC center object in object database 908 is geographically contained.

Figure 10:
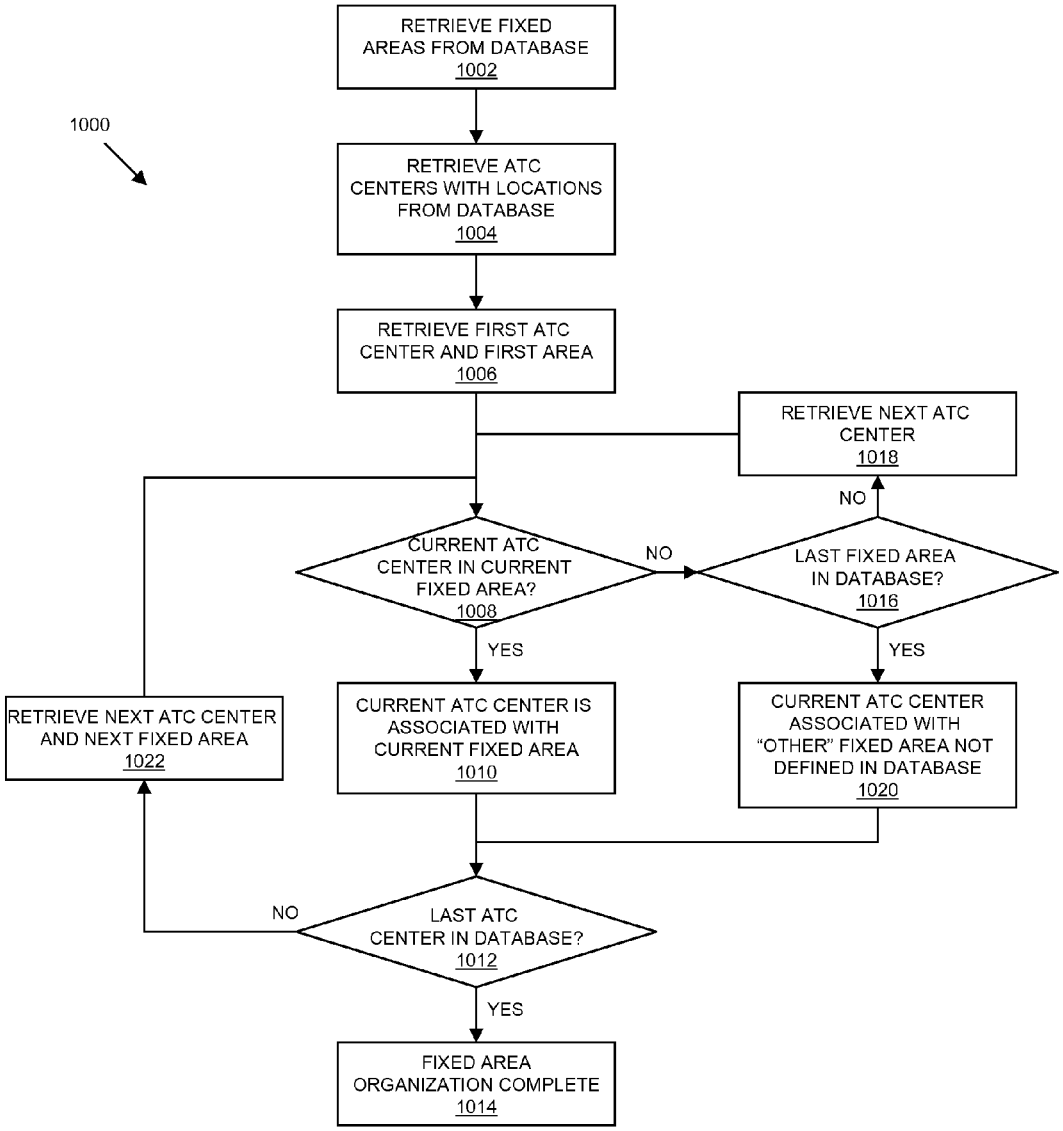
FIG. 10 is a flow diagram representing a method of organizing a plurality of ATC center objects in a hierarchal manner using the computer system of FIG. 9.

FIG. 10 is a flow diagram representing a method 1000 of organizing a plurality of ATC center objects in a hierarchal manner using computer system 900. The method 1000 is typically implemented using organization module 902 of communication management unit 204. The method 1000 starts when the fixed areas are retrieved from fixed area database 906 (block 1002). The fixed areas are used to organize the plurality of ATC center objects stored in object database 908 in a hierarchal manner, such that some of the ATC center objects are associated with one fixed area, while other ATC center objects are associated with another fixed area. The ATC center objects are retrieved from object database 908, each object including name 910, ATN address 912, and location 914 (block 1004). A first ATC center object from object database 908 is retrieved along with a first fixed area from fixed area database 906 (block 1006). The first ATC center object is now the current ATC center object and the first fixed area is now the current fixed area.

A determination is then made whether the ATC center represented by the current ATC center object is within the current area (block 1008). If the ATC center represented by the current ATC center object is within the current area, then the current ATC center object is associated with the current fixed area (block 1010). The association is done by updating associated fixed area 916 for the current ATC center object to be associated to the current fixed area in object database 908. A determination is then made whether the current ATC center object is the last ATC center object in object database 908 (block 1012). If the current ATC center is the last ATC center object in object database 908, then the fixed area organization of method 1000 is complete (block 1014). If the current ATC center object is not the last ATC center object in object database 908, then the next ATC center object and the next fixed area are retrieved and set as the current ATC center object and the current fixed area respectively (block 1022). At block 1022, the next ATC center object is retrieved from object database 908 and the next fixed area is retrieved from fixed area database 906. A determination is again made whether the ATC center represented by the current ATC center object is within the current area (block 1008). The method then proceeds as described above until the fixed area organization is complete (block 1014).

If it is determined that the ATC center represented by the current ATC center object is not within the current area (block 1008), then a determination is made whether the current fixed area is the last fixed area in fixed area database 906 (block 1016). If the current fixed area is not the last fixed area in fixed area database 906, then the next ATC center object in object database 908 is retrieved and set as the current ATC center object (block 1018). A determination is again made whether the ATC center represented by the current ATC center object is within the current area (block 1008). The method then proceeds as described above until the fixed area organization is complete (block 1014). If the current fixed area is the last fixed area in fixed area database 906, then the current ATC center object is associated with an "other" fixed area not defined in fixed area database 906 (block 1020). A determination is then made whether the current ATC center object is the last ATC center object in object database 908 (block 1012). The method 1000 then proceeds as described above until the fixed area organization is complete (block 1014). In some example embodiments, this method is periodically repeated to update object database 908. In other example embodiments it is continuously repeated or not repeated.

Figure 11:
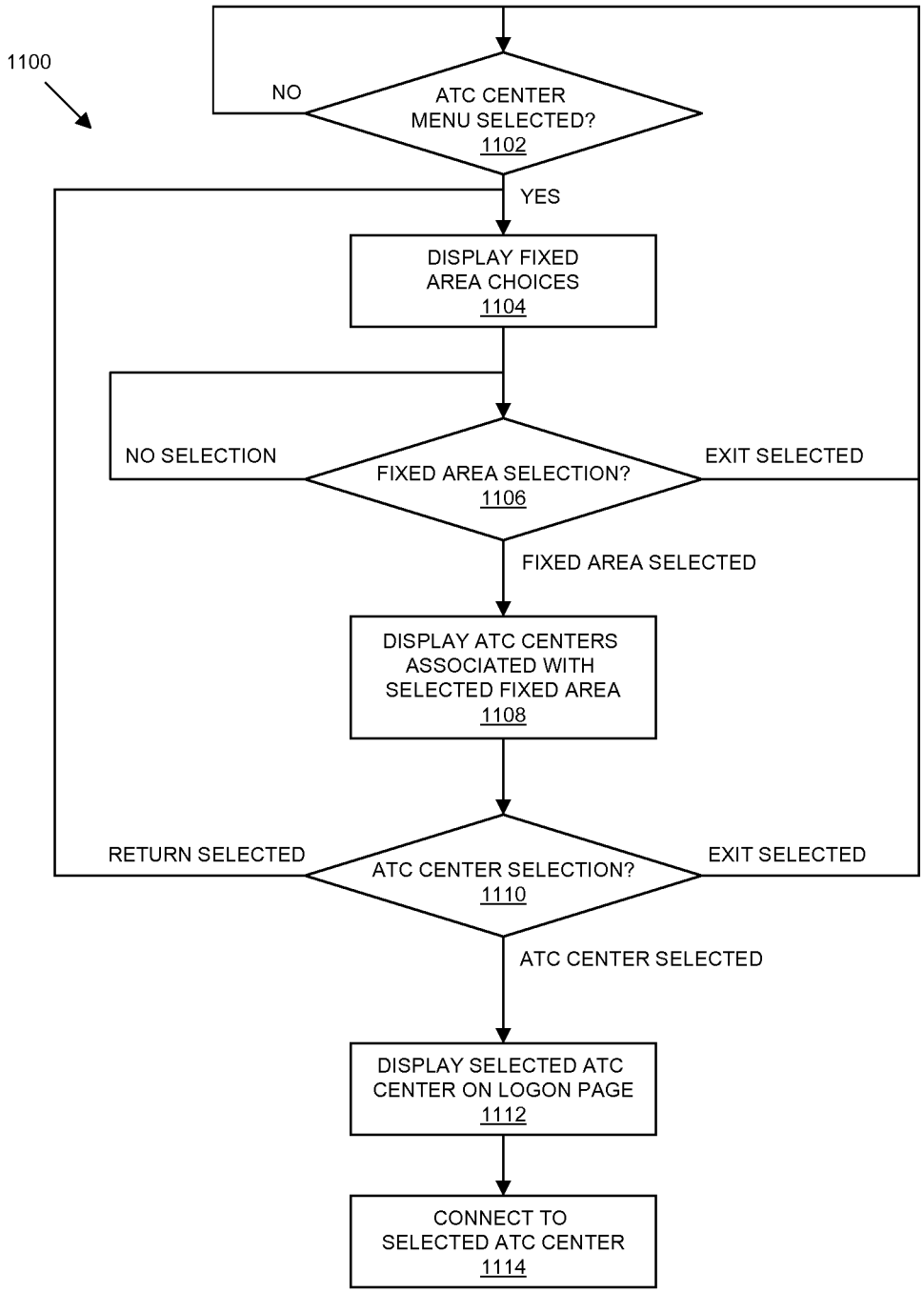
FIG. 11 is a flow diagram representing a method of presenting the plurality of ATC center objects organized in a hierarchal manner by the method of FIG. 10, using the system of FIG. 9.

FIG. 11 is a flow diagram representing a method 1100 of presenting the plurality of ATC center objects, organized in a hierarchal manner in method 1000, using computer system 900. The method 1100 is typically implemented using presentation module 904 of communication management unit 204. The method 1100 starts when a determination is made whether an ATC center menu is selected (block 1102). The ATC center menu is typically selected by a pilot and/or flight crew. The pilot and/or flight crew is typically required to select an ATC center with which to establish an initial data link. The selection is typically made using an input device, such as a button on the MCDU 206. The method 1100 waits until the ATC center menu is selected (block 1102). If an ATC center menu is selected, then the fixed areas from fixed area database 906 are displayed to the pilots and/or flight crew on MCDU 206 for selection (block 1104). Typically, each fixed area in the fixed area database 906 is displayed on a line of MCDU 206 next to a selection button similar to the display of the ICAO region choices (604) shown in FIG. 6.

A determination is then made whether a fixed area is selected (block 1106). If no fixed area is selected and an exit button is not selected, the method 1100 waits until a fixed area is selected (block 1106). If an exit button is selected, then the determination is then again made whether an ATC center menu is selected (block 1102). The method 1100 then proceeds as described. If a fixed area is selected, then the ATC centers associated with the selected fixed area are displayed (block 1108) in a manner similar to the display of the ATC centers (block 512) shown in FIG. 8. A determination is then made as to whether an ATC center selection has been made (block 1110). If an ATC center is selected from the ATC centers associated with the selected fixed area, then the selected air traffic control center 212 is displayed on the logon page (block 1112). A connection is then made to the selected air traffic control center 212 (block 1114) using radio communication device 208 to establish data link 214. If the exit button is selected (block 1110), then it is again determined whether the ATC center menu is selected (block 1102). The method 1100 then proceeds as described above until an ATC center is selected (block 1110). If the return selection button is selected (block 1110), then the fixed areas from fixed area database 906 are again displayed to the pilots and/or flight crew on MCDU 206 for selection (block 1104) and it is again determined whether a fixed area is selected (block 1106). The method 1100 then proceeds as described above until an ATC center is selected (block 1110).

Figure 12:
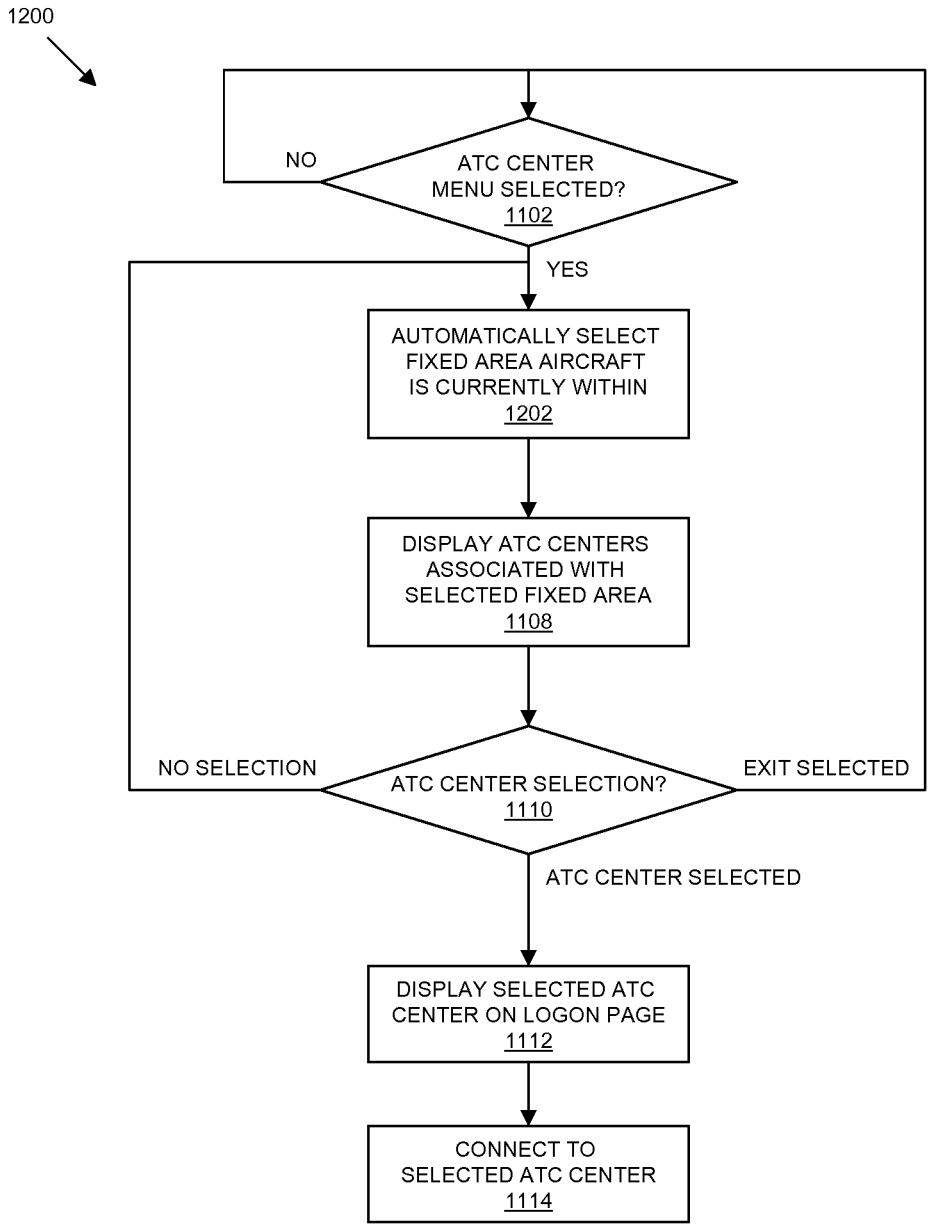
FIG. 12 is a flow diagram representing another method of presenting the plurality of ATC center objects organized in a hierarchal manner by the method of FIG. 10, using the system of FIG. 9.

FIG. 12 is a flow diagram representing another method of presenting the plurality of ATC center objects, organized in a hierarchal manner in the method of FIG. 10, using the system of FIG. 9. The method 1200 is typically implemented using presentation module 904 of communication management unit 204. The method 1200 starts when a determination is made whether an ATC center menu is selected (block 1102). The selection is typically made using an input device, such as a button on the MCDU 206. The method 1200 waits until the ATC center menu is selected (block 1102). If an ATC center menu is selected, then the fixed area in which aircraft 200 is currently within is automatically selected (block 1202). The fixed area in which aircraft 200 is currently contained is typically automatically selected by first receiving the current location of aircraft 200, in latitude and longitude, from global positioning system receiver 210. In other example embodiments, the current location of the aircraft 200 is retrieved from a navigation system, such as a FMC, or another device. Second, the current location of aircraft 200 as received from global positioning system receiver 210 is compared with the geographic boundaries of the fixed areas stored in fixed area database 906 to determine which of the fixed areas, stored in fixed area database 906, aircraft 200 is currently contained within. The fixed area, from fixed area database 906, in which aircraft 200 is currently contained is automatically selected as the selected fixed area.

The ATC centers associated with the selected fixed area are then displayed (block 1108). A determination is then made as to whether an ATC center selection has been made (block 1110). If an ATC center is selected from the ATC centers associated with the selected fixed area, then the selected air traffic control center 212 is displayed on the logon page (block 1112). A connection is then made to the selected air traffic control center 212 (block 1114) using radio communication device 208 to establish data link 214. If the exit button is selected (block 1110), then it is again determined whether the ATC center menu is selected (block 1102). The method 1100 then proceeds as described above until an ATC center is selected (block 1110). If the return selection button is selected (block 1110), then the fixed areas from fixed area database 906 are again displayed to the pilots and/or flight crew on MCDU 206 for selection (block 1104) and it is again determined whether a fixed area is selected (block 1106). The method 1100 then proceeds as described above until an ATC center is selected (block 1110).

While method 1100 and method 1200 only describe use of a single level fixed area approach, other example embodiments include multi-level fixed area approaches. In embodiments including multiple levels of fixed areas, the first level fixed areas are the largest and include multiple second level fixed areas. The second level fixed areas are the second largest and may include multiple third levels. The number of different levels may vary in different embodiments and implementations.

Figure 13:
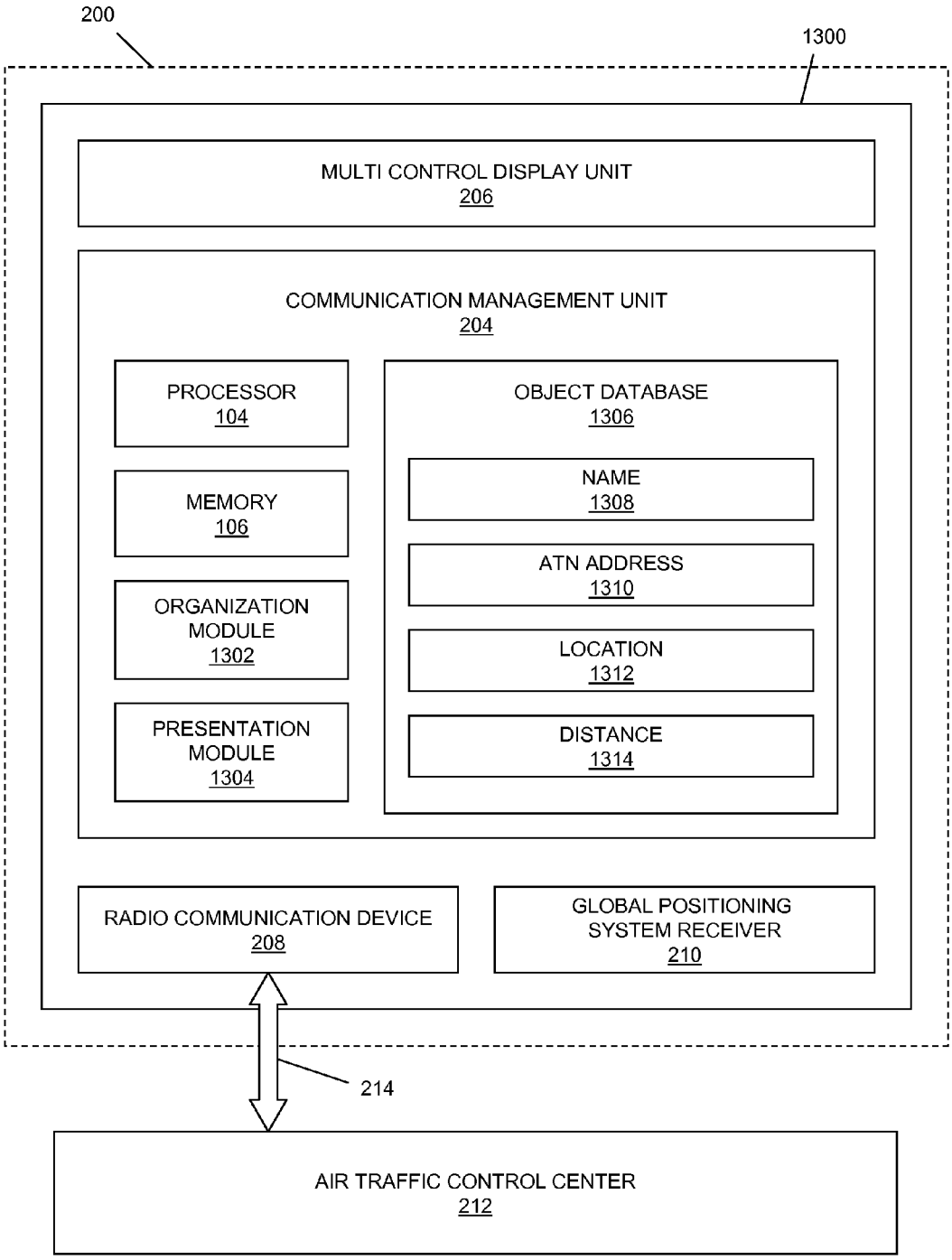
FIG. 13 is a block diagram of another specific embodiment of a computer system that can implement another method of the invention.

FIG. 13 is a block diagram of aircraft 200 having a computer system 1300 that can implement a method of the invention. The computer system 1300 is typically onboard aircraft 200. The computer system 1300 is implemented using communication management unit 204, though it can also be implemented as a flight management computer, a communications management function, a flight management function, or any other avionics computer according to computer system 100 of FIG. 1. The communication management unit 204 includes processor 104 and memory 106 described with reference to computer system 100 of FIG. 1.

As with computer system 202 above, computer system 1300 also includes MCDU 206, though in other embodiments a MFD or other display system can be used instead of MCDU 206. The computer system 1300 also includes radio communication device 208 configured to communicatively connect with air traffic control center 212 via data link 214. The methods discussed below aid the pilots and/or flight crew in the selection of air traffic control center 212 from a plurality of air traffic control centers. The computer system 1300 shown typically includes global positioning system receiver 210, which is configured to aid the pilot and/or flight crew in the selection of air traffic control center 212 according to the methods detailed below. In other example embodiments, another navigation system, such as a FMC or another device, is configured to aid the pilot and/or flight crew in the selection of air traffic control center 212.

The communication management unit 204 of the computer system 1300 includes an organization module 1302, a presentation module 1304, and an object database 1306. The organization module 1302 is configured to organize a plurality of ATC center objects stored in object database 1306 in a heirarchal manner detailed below. The presentation module 1304 is configured to present the plurality of ATC center objects from object database 1306 to the pilots and/or flight crew according to the hierchal organization performed by organization module 1302 detailed below.

The object database 1306 typically includes a plurality of ATC center objects. Each individual ATC center object in object database 1306 includes name 1308, ATN address 1310, location 1312, and a distance 1314 from aircraft 200. Each name 1308 is typically a descriptive name of a specific ATC center represented by the particular ATC center object in object database 1306. The ATN address 1310 associated with each ATC control center object represents the actual unique ATN address of the ATC center represented by the particular ATC center object in object database 1306. The location 1312 associated with each ATC center object represents the physical location, in latitude and longitude, of the ATC center represented by the particular ATC center object in object database 1306. The distance 1314 from aircraft 200 is the distance between the physical location of aircraft 200 and the physical location of the ATC center represented by the particular ATC center object in object database 1306.

Figure 14:
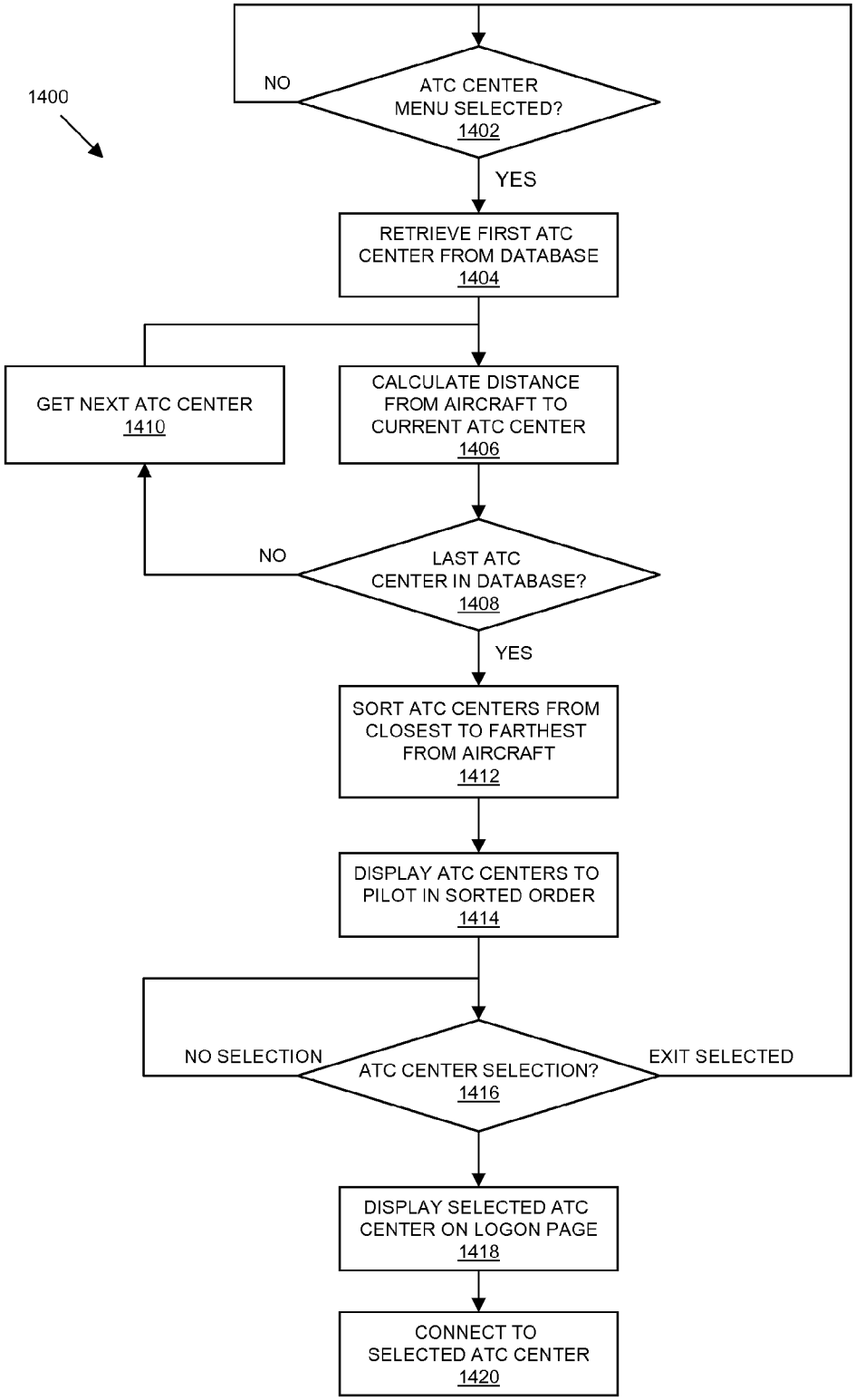
FIG. 14 is a flow diagram representing a method of organizing and presenting a plurality of ATC center objects in a hierarchal manner using the computer system of FIG. 13.

FIG. 14 is a flow diagram representing a method of organizing and presenting a plurality of ATC center objects in a hierarchal manner using the computer system 1300. The method 1400 is typically implemented using organization module 1302 and presentation module 1304 of communication management unit 204. The method 1400 starts when a determination is made whether an ATC center menu is selected (block 1402). The selection is typically made using an input device, such as a button on the MCDU 206. The method 1400 waits until the ATC center menu is selected (block 1402). If the ATC center menu is selected, then the first ATC center object is retrieved from object database 1306 (block 1404). The first ATC center object is now the current ATC center object. The distance 1314 from aircraft 200 is calculated by determining the distance between the current location of aircraft 200 and the current location of the current ATC center object (block 1406). The current location of aircraft 200 in latitude and longitude is typically retrieved from the global positioning system receiver 210. The current location of the current ATC center object is typically retrieved from location 1312 of the current ATC center object. The distance between the current location of aircraft 200 and the location of the ATC center represented by the current ATC center object is typically calculated and saved in distance 1314 from aircraft 200 for the current ATC center object.

A determination is then made whether the current ATC center object is the last ATC center object in object database 1306 (block 1408). If the current ATC center object is not the last ATC center object in object database 1306, then the next ATC center object in object database 1306 is retrieved and becomes the current ATC center object (block 1410). The distance 1314 from aircraft 200 for the current ATC center object is again calculated by determining the distance between the current location of aircraft 200 and the location of the ATC center represented by the current ATC center object (block 1406). The method 1400 then proceeds as described above until the last ATC center object has had its distance 1314 from aircraft 200 calculated. If the current ATC center object is the last ATC center object in object database 908 (1408), then the ATC center objects in object database 1306 are sorted from closest to farthest from aircraft 200 (block 1412). The sorting is done based on distance 1314 from aircraft 200 of each of the ATC center objects in object database 1306.

The names of the ATC center objects in object database 1306 are displayed to a pilot and/or flight crew in order, closest to farthest away (block 1414). While these names may span multiple pages on the MCDU 206, the names of the closest ATC centers will be displayed first. A determination is then made as to whether an ATC center selection has been made (block 1416). If an ATC center is selected from the ATC centers displayed in sorted order, then the air traffic control center 212 is displayed on the logon page (block 1418). A connection is then made to the selected air traffic control center 212 (block 1420) using radio communication device 208 to establish data link 214. If the exit button is selected, then it is again determined whether the ATC center menu is selected (block 1402). The method 1100 then proceeds as described above until an ATC center is selected (block 1416). If no selection is made, then a determination is again made as to whether an ATC center selection has been made (block 1416). The method 1400 then proceeds as described above until an ATC center is selected (block 1416).

In some embodiments, ATC centers covering geographic areas that intersect the proposed flight path of the aircraft 200 will be prioritized over ATC centers that do not cover geographic areas that intersect the proposed flight path of the aircraft 200. Thus, while a first ATC center found behind the aircraft 200 may be closer to the aircraft 200 than a second ATC center found in front of the aircraft 200, the second ATC center will still be prioritized higher than the first ATC center if it covers a geographic area that is intersected by the flight path of the aircraft 200, while the first ATC center behind the aircraft 200 does not.

In some embodiments, blocks 1404 through 1412 occur prior to block 1402. In specific implementations, blocks 1404 through 1412 are automatically repeated periodically or continuously to keep the ATC center objects in object database 1306 currently sorted from closest to farthest from aircraft 200.

In other embodiments, various embodiments and implementations as described previously can be combined with one another. For example, some embodiments may combine the sorting from method 1400 of FIG. 14 with method 500 of FIG. 5. In specific implementations of method 500 including the sorting from method 1400, the ICAO regions are displayed in sorted order from closest to farthest away (block 504), the countries are displayed in sorted order from closest to farthest away (block 508), and the ATC centers are displayed in sorted order from closest to farthest away (block 512). In other implementations of method 500, the ICAO regions are displayed in sorted alphabetical order (block 504), the countries are displayed in sorted alphabetical order (block 508), and the ATC centers are displayed in sorted alphabetical order (block 512). In other implementations of method 500, the ICAO regions are displayed in an order based on how often they are typically chosen, the countries are displayed in an order based on how often they are typically chosen, and the ATC centers are displayed in an order based on how often they are typically chosen. In other implementations, the ATC centers are displayed in an order as assigned by an airline or device manufacturer. In other embodiments and implementations, other sorting techniques are used. The sorting from method 1400 of FIG. 14, an alphabetical sorting, or other techniques can also be implemented into the display of fixed area choices 1104 and the display of ATC centers associated with selected fixed area 1108.

The present invention may be embodied in other specific forms without departing from its essential characteristics. The described embodiments are to be considered in all respects only as illustrative and not restrictive. The scope of the invention is therefore indicated by the appended claims rather than by the foregoing description. All changes that come within the meaning and range of equivalency of the claims are to be embraced within their scope. Any features shown or described in one embodiment may be combined with, or replace, features shown in other embodiments.

What is claimed is:

1. A method of organizing and presenting a plurality of air traffic control centers in a hierarchal manner using a computer system to support connection to a selected air traffic control center using a radio communication device to establish a data communication link, the method comprising:

calculating a distance between each of a plurality of air traffic control centers and an aircraft during flight;

displaying a sorted list of the plurality of air traffic control centers to a user, wherein the list is sorted by the calculated distance, from closest to the aircraft to farthest from the aircraft;

receiving an input from the user, the input selecting one of the air traffic control centers; and sending a logon message to the selected air traffic control center via a radio communication device to establish a data communication link between the radio communication device and the selected air traffic control center.

2. The method of claim 1, further comprising:

sorting the air traffic control centers by the calculated distance, from closest to the aircraft to farthest from the aircraft.

3. The method of claim 1, further comprising:

displaying the selected air traffic control centers on a logon page.

4. The method of claim 1, further comprising:

establishing the data communication link between the radio communication device and the selected air traffic control center.

5. The method of claim 1, further comprising:

retrieving physical location data for the aircraft from a global positioning system (GPS) receiver onboard the aircraft.

6. The method of claim 1, further comprising:

retrieving physical location data for each of the plurality of air traffic control centers from an air traffic control center object database.

7. A computer program product comprising program instructions for organizing and presenting a plurality of air traffic control centers in a hierarchal manner to support connection to a selected air traffic control center using a radio communication device to establish a data communication link, embodied on a non-transitory machine-readable storage medium, the program instructions cause at least one processor to:

calculate a distance between each of a plurality of air traffic control centers and an aircraft during flight;

display a sorted list of the plurality of air traffic control centers to a user, wherein the list is sorted by the calculated distance, from closest to the aircraft to farthest from the aircraft; and receive an input from a user, the input selecting one of the air traffic control centers; and send a logon message to the selected air traffic control center via a radio communication device to establish a data communication link between the radio communication device and the selected air traffic control center.

8. The computer program product of claim 7, wherein the program instructions further cause the at least one processor to:

retrieve location data for the aircraft from a global positioning system (GPS) receiver onboard the aircraft.

9. A system onboard an aircraft for organizing and presenting a plurality of air traffic control centers in a hierarchal manner to support connection to a selected air traffic control center using a radio communication device to establish a data communication link, comprising:

at least one memory device;

at least one processor in operative communication with the memory device, the at least one processor configured to calculate a distance between each of a plurality of air traffic control centers and the aircraft during flight;

at least one display device configured to display a sorted list of the plurality of air traffic control centers to a user, wherein the list is sorted by the calculated distance, from closest to the aircraft to farthest from the aircraft;

at least one input device configured to receive an input selecting one of the air traffic control centers from a user; and at least one radio communication device configured to send a logon message to the selected air traffic control center to establish a data communication link between the radio communication device and the selected air traffic control center.

10. The system of claim 9, wherein the at least one processor is further configured to sort the air traffic control centers by the calculated distance, from closest to the aircraft to farthest from the aircraft.

11. The system of claim 9, wherein the at least one display device is further configured to display the selected air traffic control centers on a logon page.

12. The system of claim 9, wherein the at least one processor is further configured to retrieve physical location data for the aircraft from a global positioning system (GPS) receiver onboard the aircraft.

13. The system of claim 9, wherein the at least one processor is further configured to retrieve physical location data for each of the plurality of air traffic control centers from an air traffic control center object database stored on the at least one memory device.

14. The system of claim 9, wherein the at least one processor is part of at least one of a communication management function (CMF), a communication management unit (CMU), and a flight management computer (FMC) onboard the aircraft.

15. The system of claim 9, wherein the at least one display device is part of at least one of a Multi-Control Display Unit (MCDU) and a Multi Function Display (MFD) system.

16. The system of claim 9, wherein the at least one input device is part of at least one of a Multi-Control Display Unit (MCDU) and a Multi Function Display (MFD) system.

17. The system of claim 9, wherein the at least one display device and the at least one input device are part of human-machine interface (HMI).

18. The method of claim 1, further comprising communicating Controller Pilot Data Link Communication (CPDLC) application messages across the data communication link between the radio communication device and the selected air traffic control center.

19. The computer program product of claim 7, wherein the program instructions further cause the at least one processor to:

communicate Controller Pilot Data Link Communication (CPDLC) application messages across the data communication link between the radio communication device and the selected air traffic control center via the radio communication device.

20. The system of claim 9, wherein the at least one radio communication device is further configured to communicate Controller Pilot Data Link Communication (CPDLC) application messages across the data communication link between the radio communication device and the selected air traffic control center.

* * * * *